US012338551B2

(12) United States Patent
Nakamura et al.

(10) Patent No.: US 12,338,551 B2
(45) Date of Patent: Jun. 24, 2025

(54) INORGANIC SUBSTANCE POWDER-BLENDED SPUNBOND NONWOVEN FABRIC

(71) Applicant: TBM CO., LTD., Tokyo (JP)

(72) Inventors: Hiroshi Nakamura, Tokyo (JP); Satoshi Matsuda, Tokyo (JP)

(73) Assignee: TBM CO., LTD., Tokyo (JP)

( * ) Notice: Subject to any disclaimer, the term of this patent is extended or adjusted under 35 U.S.C. 154(b) by 277 days.

(21) Appl. No.: 17/792,059

(22) PCT Filed: Oct. 27, 2020

(86) PCT No.: PCT/JP2020/040307

§ 371 (c)(1),
(2) Date: Jul. 11, 2022

(87) PCT Pub. No.: WO2021/145049

PCT Pub. Date: Jul. 22, 2021

(65) Prior Publication Data

US 2023/0057576 A1 Feb. 23, 2023

(30) Foreign Application Priority Data

Jan. 14, 2020 (JP) ..... 2020-003809

(51) Int. Cl.
*D01F 6/46* (2006.01)
*D01F 1/10* (2006.01)
*D04H 3/007* (2012.01)

(52) U.S. Cl.
CPC ..... *D01F 6/46* (2013.01); *D01F 1/10* (2013.01); *D04H 3/007* (2013.01); *D10B 2321/021* (2013.01); *D10B 2321/022* (2013.01); *D10B 2401/041* (2013.01)

(58) Field of Classification Search
CPC ..... D01F 6/46; D01F 1/10; D01D 5/0985; D04H 3/007; D10B 2321/022; D10B 2401/041
USPC ..... 442/375, 381, 382, 400, 401, 417
See application file for complete search history.

(56) References Cited

U.S. PATENT DOCUMENTS 6,759,357 B1 * 7/2004 Toriumi ..... D04H 13/00 524/588
2013/0316607 A1 11/2013 Ichikawa et al.
2014/0100328 A1 4/2014 Sumi et al.
2015/0210038 A1 7/2015 Ichikawa et al.
2017/0314174 A1 11/2017 Ichikawa et al.
2017/0355104 A1 12/2017 Brunner et al.

FOREIGN PATENT DOCUMENTS

CN 101798419 A 8/2010
CN 101871182 A 10/2010
CN 101798419 B 8/2012
CN 102673061 A 9/2012
JP H1088459 A 4/1998
JP H10212650 A 8/1998
JP 2000096416 A 4/2000
JP 2007107117 A 4/2007
JP 2010529309 A 8/2010
JP 2013010931 A 1/2013
JP 2015504450 A 2/2015
JP 2016508190 A 3/2016
JP 2018115419 A 7/2018
JP 2018127735 A 8/2018
KR 20170086113 * 7/2017
WO 2008077156 A2 6/2008
WO 2012111724 A1 8/2012
WO 2013061068 A1 5/2013
WO 2014030702 A1 2/2014
WO 2014102197 A1 7/2014
WO 2016068312 A1 5/2016

OTHER PUBLICATIONS

Cai Shaoling, et. al., "Packaging Technology Manual", Japan Packaging Technology Association, pp. 377-381, Mechanical Technology Press, 1st edition in May 1994; 17 pages.
SIPO Rejection Decision for corresponding CN Application No. 202080092622.5; Issued May 17, 2024; 11 pages.
Wei Fengjun, "Research on Optimization Design of Paper Packaging Structure", p. 265, Metallurgical Industry Press, 1st edition in Jul. 2019; 7 pages.
George Wypych, "Filing Manual Second Edition", Translated by Cheng Bin, et.al., p. 404, Sinopec Press, first edition in Oct. 2002, first printing in Feb. 2003; 7 pages.
CNIPA, The Third Office Action for corresponding CN Application No. 202080092622.5; Issuing Date: Feb. 1, 2024; 12 pages.
International Search Report for International Application No. PCT/JP2020/040307; Mailing Date: Nov. 24, 2020.
(Continued)

*Primary Examiner* — Camie S Thompson
(74) *Attorney, Agent, or Firm* — CANTOR COLBURN LLP

(57) ABSTRACT

Provided is a spunbond nonwoven fabric that is easy to produce due to excellent spinnability and has uniform and sufficient quality including mechanical properties while the spunbond nonwoven fabric is highly filled with an inorganic substance powder. An inorganic substance powder-blended spunbond nonwoven fabric is composed of a fiber, the fiber including: a thermoplastic resin and an inorganic substance powder in a mass ratio of 50:50 to 10:90, and an ethylene-based polymer wax having a weight average molecular weight of 400 or more and 5,000 or less in an amount of 0.1 part by mass or more and 3.0 parts by mass or less relative to 100 parts by mass of a total amount of the thermoplastic resin and the inorganic substance powder.

10 Claims, No Drawings

(56) References Cited

OTHER PUBLICATIONS

Extended European Search Report for corresponding EP Application No. 20914428.6, Issued Jan. 8, 2025.

* cited by examiner

INORGANIC SUBSTANCE POWDER-BLENDED SPUNBOND NONWOVEN FABRIC

CROSS REFERENCE TO RELATED APPLICATIONS

This is the U.S. national stage of application No. PCT/JP2020/040307, filed on Oct. 27, 2020. Priority under 35 U.S.C. § 119(a) and 35 U.S.C. § 365(b) is claimed from Japanese Application No. 2020-003809, filed Jan. 14, 2020, the disclosure of which is also incorporated herein by reference.

FIELD

The present invention relates to an inorganic substance powder-blended spunbond nonwoven fabric.

BACKGROUND

Conventionally, nonwoven fabrics composed of fibers produced by melt spinning have been widely used as medical materials, sanitary materials, filters, construction and civil engineering materials, covering materials, separators, absorbent products, packaging materials, carrying materials, backing materials, and daily commodities including clothing (refer to, for example, Patent Literatures 1 to 4).

From the viewpoint of environmental protection, however, reduction in the consumption amount of thermoplastic resins used in the melt spinning fibers has become a recent problem. From such a viewpoint, inorganic substance powder-blended thermoplastic resin compositions prepared by highly blending inorganic substance powders in thermoplastic resins have been developed and put into practical use (refer to, for example, Patent Literature 5). As the inorganic substance powders, in particular, calcium carbonate is a resource that exists in abundance in the natural world and can favorably respond to demands from the viewpoint of environmental protection.

In addition, blend of the inorganic substance powder allows various physical properties to the fibers depending on the properties of the inorganic substance powder to be blended such as coloration of the fibers, high whiteness, hydrophilic or hydrophobic properties, a separation function, and a catalytic function to be imparted. For example, blend of calcium carbonate allows soft touch to be imparted while the rigidity of the nonwoven fabric is being improved. Highly filled inorganic substance powders including barium sulfate allow a nonwoven fabric for X-ray work to be prepared. Therefore, fibers of thermoplastic resins blended with inorganic substance powders and nonwoven fabrics made of these fibers have been developed (refer to, for example, Patent Literatures 6 to 8).

CITATION LIST

Patent Literature

Patent Literature 1: Japanese Patent Application Laid-open No. 2018-115419

Patent Literature 2: WO No. 2016/068312 Pamphlet

Patent Literature 3: WO No. 2014/030702 Pamphlet

Patent Literature 4: WO No. 2012/111724 Pamphlet

Patent Literature 5: Japanese Patent Application Laid-open No. 2013-010931

Patent Literature 6: Published Japanese Translation of PCT International Publication for Patent Application No. 2015-504450

Patent Literature 7: Published Japanese Translation of PCT International Publication for Patent Application No. 2010-529309

Patent Literature 8: Published Japanese Translation of PCT International Publication for Patent Application No. 2016-508190

SUMMARY

Technical Problem

In conventional nonwoven fabrics, however, the maximum amount of the inorganic substance powder in the spunbond fiber has been about 20% to 40% by mass from the viewpoint of handling. For example, although Patent Literatures 1 to 4 have described blend of pigments and fillers, there is no description of the blend amount thereof and no inorganic substance powder is blended in Examples. Patent Literature 5 has disclosed resin compositions including 60 to 82% by weight of an inorganic substance powder but has not described fibers and nonwoven fabrics made of such compositions. Patent Literatures 6 and 7 have described polymer compositions including granular fillers with few coarse particles and spunlaid fibers made of such compositions have also been disclosed. The amount of the granular filler in the fiber, however, has been described to be less than 40% by mass relative to the total mass of the fiber and the amount of calcium carbonate blended in Examples is roughly 20% by mass or less and 25% by mass at a maximum. Moreover, in Examples in Patent Literature 7, fiber clumps have been observed in a nonwoven fabric having a content of calcium carbonate of 25% by mass. Patent Literature 8 has disclosed a nonwoven fabric including polyester and calcium carbonate. The amount of calcium carbonate is described as 0.1 to 50% by weight, but the amounts of calcium carbonate in Examples are 10 to 20% by weight. Similar to the nonwoven fabric described in Patent Literature 7, it is presumed that the nonwoven fabric described in Patent Literature 8 may be unbearable for practical use if the calcium carbonate content is determined to be about 25% mass or more. In addition, this level of the amount of the blended inorganic substance powder results in insufficient reduction in the consumed amount of thermoplastic resins and thus hardly contributes to solving environmental problems.

As described above, however, highly filled blend of the inorganic substance powder causes problems in handling at the time of processing and deterioration in physical properties of textile products. In particular, addition of the inorganic substance powder such as calcium carbonate in an amount of more than 50% by mass has caused a significant problem of not obtaining uniform mechanical properties and quality uniformity when the spunbond nonwoven fabrics are produced because this addition results in variation in properties caused by partial agglomeration of the inorganic substance powder and non-uniformity of spunbond fiber properties caused by poor compatibility between the inorganic powder and the resin.

In order to improve the spinnability, a technology of blending additives such as processing aids into the polymer (composition) serving as a fiber raw material has been known. However, when the inventors of the present invention have examined this technology, the inventors of the present invention have found that the spunbond fiber highly filled with the inorganic substance powder cannot not be sufficiently improved in properties even when additives such as processing aids used in general resin processing are used.

The present invention is made in view of the above actual situation and an object of the present invention is to provide a spunbond nonwoven fabric that is easy to produce due to excellent spinnability and has uniform and sufficient quality including mechanical properties while the spunbond nonwoven fabric is highly filled with the inorganic substance powder.

Solution to Problem

As a result of intensive study, the inventors of the present invention have found that a spunbond nonwoven fabric can be stably produced while a spunbond fiber composition includes a high filled inorganic substance powder of 50% by mass or more and the spunbond nonwoven fabric having excellent properties can be obtained by blending a specific amount of an ethylene-based polymer wax having a weight average molecular weight of 400 to 5,000 or more. Consequently, the present invention has been attained. Specifically, the present invention provides the followings.

(1) An inorganic substance powder-blended spunbond nonwoven fabric composed of a fiber, the fiber comprising: a thermoplastic resin and an inorganic substance powder in a mass ratio of 50:50 to 10:90, and an ethylene-based polymer wax having a weight average molecular weight of 400 or more and 5,000 or less in an amount of 0.1 part by mass or more and 3.0 parts by mass or less relative to 100 parts by mass of a total amount of the thermoplastic resin and the inorganic substance powder.

(2) The inorganic substance powder-blended spunbond nonwoven fabric according to (1), in which the inorganic substance powder is heavy calcium carbonate particles having an average particle diameter determined by an air permeation method in accordance with JIS M-8511 of 1.0 μm or more and 5.0 μm or less.

(3) The inorganic substance powder-blended spunbond nonwoven fabric according to (2), in which a BET specific surface area of the heavy calcium carbonate particles is 0.1 $m^2/g$ or more and 10.0 $m^2/g$ or less.

(4) The inorganic substance powder-blended spunbond nonwoven fabric according to (2) or (3), in which a roundness of the heavy calcium carbonate particles is 0.50 or more and 0.95 or less.

(5) The inorganic substance powder-blended spunbond nonwoven fabric according to any one of (1) to (4), in which the thermoplastic resin is a thermoplastic resin comprising a polypropylene-based resin.

(6) The inorganic substance powder-blended spunbond nonwoven fabric according to (5), in which the polypropylene-based resin is a homopolymer of polypropylene having a melt flow rate (MFR) of 50 g/10 min or more and 70 g/10 min or less.

(7) The inorganic substance powder-blended spunbond nonwoven fabric according to any one of (1) to (6), in which a density of the ethylene-based polymer wax is 0.890 $g/cm^3$ or more and 0.990 $g/cm^3$ or less.

Advantageous Effects of Invention

According to the present invention, a spunbond nonwoven fabric that is easy to produce due to excellent spinnability and has uniform and sufficient quality including mechanical properties while the spunbond nonwoven fabric is highly filled with the inorganic substance powder is provided. The resin composition including the ethylene-based polymer wax having a weight average molecular weight of 400 to 5,000 according to the present invention has excellent spinnability, and thus the inorganic substance powder-blended spunbond nonwoven fabric according to the present invention is easy to produce. In addition, in the inorganic substance powder-blended spunbond nonwoven fabric, the inorganic substance powder is uniformly dispersed, the fibers do not break due to agglomerated parts of the powder and the like serving as starting points, and the physical properties of each part are uniform. The spunbond nonwoven fabric according to the present invention includes a large amount of inorganic substance powder, which can reduce the consumption amount of the thermoplastic resin and thus also contribute to solving environmental problems.

DESCRIPTION OF EMBODIMENTS

Hereinafter, the embodiments of the present invention will be described in detail. The present invention, however, is not particularly limited to these embodiments.

The inorganic substance powder-blended spunbond nonwoven fabric (hereinafter, also simply referred to as "nonwoven fabric" or "spunbond nonwoven fabric") according to the present invention is composed of the fiber of an inorganic substance powder-containing resin composition. The inorganic substance powder-containing resin composition includes the thermoplastic resin and the inorganic substance powder in a mass ratio of 50:50 to 10:90 and includes the ethylene-based polymer wax having a weight average molecular weight of 400 to 5,000 in a proportion of 0.1 part by mass or more 3.0 parts by mass or less relative to 100 parts by mass of the total mass of the thermoplastic resin and the inorganic substance powder.

Although the inorganic substance powder-containing resin composition may include components other than the components described above, preferably 90% by mass or more and more preferably 95% by mass or more of the inorganic substance powder-containing resin composition is composed of the thermoplastic resin, the inorganic substance powder, and the ethylene-based polymer wax when the entire inorganic substance powder-filled resin composition is determined to be 100% by mass.

<<Inorganic Substance Powder-Containing Resin Composition>>

[Thermoplastic Resin]

The thermoplastic resin is not particularly limited and various types of the thermoplastic resins can be used depending on the application and function of the nonwoven fabric. Examples of the thermoplastic resin include polyolefin-based resins such as polyethylene-based resins, polypropylene-based resins, poly(methyl-1-pentene), and ethylene-cyclic olefin copolymers; functional group-containing polyolefin resins such as ethylene-vinyl acetate copolymers, ethylene-acrylic acid copolymers, ethylene-methacrylic acid copolymers, metal salts of ethylene-methacrylic acid copolymers (ionomers), ethylene-acrylic acid alkyl ester copolymers, ethylene-methacrylic acid alkyl ester copolymers, maleic acid-modified polyethylene, and maleic acid-modified polypropylene; polyimide-based resins such as nylon-6, nylon-6,6, nylon-6,10, and nylon-6,12; thermoplastic polyester resins such as aromatic polyester-based resins including polyethylene terephthalate and copolymers thereof, polyethylene naphthalate, and polybutylene terephthalate, and aliphatic polyester-based resins including polybutylene succinate and polylactic acid; polycarbonate resins such as aromatic polycarbonates and aliphatic polycarbonates; polystyrene-based resins such as atactic polystyrene, syndiotactic polystyrene, acrylonitrile-styrene (AS) copolymers, and acrylonitrile-butadiene-styrene (ABS) copolymers; polyvinyl chloride-based resins such as polyvinyl chloride and polyvinylidene chloride; polyphenylene sulfide; and polyether-based resins such as polyethersulphone, polyetherketone, and polyetheretherketone. These thermoplastic resins may be used singly or in combination of two or more of these thermoplastic resins.

Of these thermoplastic resins, the polyolefin-based resins, the aromatic polyester-based resins, and the aliphatic polyester-based resins, in particular the polyolefin-based resins are preferably included from the viewpoint of ease of molding, performance aspects, economic aspects, and the like of the thermoplastic resins.

Here, the polyolefin-based resins refer to polyolefin-based resins in which an olefin component unit serves as a main component. Specific examples of the polyolefin-based resins include the polypropylene-based resins and the polyethylene-based resins as described above, in addition, polymethyl-1-pentene, and ethylene-cyclic olefin copolymers, as well as mixtures of two or more of these resins. The term "serve as a main component" means that 50% by mass or more of the olefin component unit is contained in the polyolefin-based resin. The content is preferably 75% by mass or more, more preferably 85% by mass or more, and further preferably 90% by mass or more. The method for producing the polyolefin-based resin is not particularly limited. The polyolefin-based resin may be obtained by any of methods using a Ziegler-Natta catalyst, a metallocene catalyst, a radical initiator such as oxygen or a peroxide, and the like.

Examples of the polypropylene-based resin include resins including a propylene component unit of 50% by mass or more. Examples of the resin include propylene homopolymers or copolymers of propylene and other α-olefins copolymerizable with propylene. Examples of the other α-olefins that can be copolymerized with propylene include α-olefins having a carbon number of 4 to 10 such as ethylene, 1-butene, isobutylene, 1-pentene, 3-methyl-1-butene, 1-hexene, 3,4-dimethyl-1-butene, 1-heptene, and 3-methyl-1-hexene.

As the propylene homopolymers, any of isotactic polypropylene, syndiotactic polypropylene, atactic polypropylene, hemiisotactic polypropylene, and linear or branched polypropylene exhibiting various stereoregularities are included. The copolymer of propylene and other α-olefins copolymerizable with propylene may be a random copolymer or a block copolymer and may be not only a binary copolymer but also a ternary copolymer. Specific examples thereof include an ethylene-propylene random copolymer, a butene-1-propylene random copolymer, an ethylene-butene-1-propylene random ternary copolymer, and an ethylene-propylene block copolymer. The other olefin copolymerizable with propylene in the above copolymer is preferably contained in a proportion of 25% by mass or less and particularly 15% by mass or less in the case where the total mass of the inorganic substance powder-filled resin composition is determined to be 100% by mass. These polypropylene-based resins can be used singly or in combination of two or more of the polypropylene-based resins.

Examples of the polyethylene-based resin include resins having an ethylene component unit of 50% by mass or more. Examples of the polyethylene-based resin include high-density polyethylene (HDPE), low-density polyethylene (LDPE), medium-density polyethylene, linear low-density polyethylene (LLDPE), an ethylene-vinyl acetate copolymer, an ethylene-propylene copolymer, an ethylene-propylene-butene-1 copolymer, an ethylene-butene-1 copolymer, an ethylene-hexene-1 copolymer, an ethylene-4-methylpentene-1 copolymer, an ethylene-octene-1 copolymer, and a mixture of two or more of these resins.

Polyethylene having a density of 0.942 g/cm$^3$ or more is usually referred to as "high-density polyethylene (HDPE)". Polyethylene having a density of 0.930 g/cm$^3$ or more and less than 0.942 g/cm$^3$ is usually referred to as "medium-density polyethylene". Polyethylene having a density of 0.910 g/cm$^3$ or more and less than 0.930 g/cm$^3$ is usually referred to as "low-density polyethylene (LUPE)". Polyethylene having a density of less than 0.910 g/cm$^3$ is usually referred to as "ultra-low-density polyethylene (ULDPE)". "Linear low-density polyethylene (LLDPE)" usually has a density of 0.911 g/cm$^3$ or more and less than 0.940 g/cm$^3$, and preferably 0.912 g/cm$^3$ or more and less than 0.928 g/cm$^3$.

Of the polyolefin-based resins described above, the polypropylene-based resin is preferably used because the polypropylene-based resin has particularly excellent balance between mechanical strength and heat resistance.

The polypropylene-based resin used here is not particularly limited and various known polypropylene-based resins can be used. A polypropylene homopolymer having a melt flow rate (MFR) of 50 g/10 min or more and 70 g/10 min or less, and particularly 55 g/10 min or more and 65 g/10 min or less is preferably used. Use of the polypropylene homopolymer having MFR within this range allows the spinnability of the inorganic substance powder-containing resin composition to be improved and the nonwoven fabric having more stable and uniform quality to be obtained. As described above, the polypropylene-based resin may have any stereoregularity. Polypropylene in which the main component has the isotactic structure is preferably used. Use of polypropylene having such a steric structure allows the spinnability and the physical properties of the obtained nonwoven fabric to be further improved. From the same perspective, polypropylene having a density of 0.86 g/cm$^3$ or more and 0.95 g/cm$^3$ and particularly preferably 0.88 to 0.93 g/cm$^3$ is preferably used.

[Inorganic Substance Powder]

The inorganic substance powder is not particularly limited. Examples of the inorganic substance powder include carbonates, sulfates, silicates, phosphates, borates, and oxides of calcium, magnesium, aluminum, titanium, iron, and zinc, or hydrates thereof in the form of powder. Specific examples of the inorganic substance powder include calcium carbonate, magnesium carbonate, zinc oxide, titanium oxide, silica, alumina, clay, talc, kaolin, aluminum hydroxide, magnesium hydroxide, aluminum silicate, magnesium silicate, calcium silicate, aluminum sulfate, magnesium sulfate, calcium sulfate, magnesium phosphate, barium sulfate, silica sand, carbon black, zeolite, molybdenum, diatomaceous earth, sericite, shirasu, calcium sulfite, sodium sulfate, potassium titanate, bentonite, wollastonite, dolomite, and graphite. These inorganic substance powders may be synthetic products or products originated from natural minerals and may be used singly or in combination of two or more of these inorganic substance powders.

In addition, the shape of the inorganic substance powder is not particularly limited and may be in the form of any of particles, flakes, granules, fibers, and the like. The particle shape may be a spherical shape as is generally obtained by synthetic methods, or an irregular shape as is obtained by grinding collected natural minerals.

Preferable examples of these inorganic substance powders include calcium carbonate, magnesium carbonate, zinc oxide, titanium oxide, silica, alumina, clay, talc, kaolin, aluminum hydroxide, magnesium hydroxide, and barium sulfate. Calcium carbonate is particularly preferable. As calcium carbonate, both of what is called light calcium carbonate prepared by a synthesis method and what is called heavy calcium carbonate obtained by mechanically grinding and classifying natural raw materials including $CaCO_3$ as the main component such as limestone may be used, and the combination thereof may also be used. Heavy calcium carbonate is preferably used.

Here, heavy calcium carbonate is a product obtained by mechanically grinding and processing natural limestone or the like and is clearly distinguished from synthetic calcium carbonate produced by chemical precipitate reaction or the like. The grinding method includes a dry method and a wet method. From the viewpoint of economic efficiency, the dry method is preferable.

The heavy calcium carbonate particles are different from, for example, light calcium carbonate produced by the synthesis method and is characterized by irregular shape properties of the surface and a large specific surface area due to particle formation performed by grinding treatment. As described above, the heavy calcium carbonate particles have the irregular shape and the large specific surface area and thus have more contact interfaces with respect to the thermoplastic resin when blended in the thermoplastic resin, which is effective for uniform dispersion.

In order to improve the dispersibility of the inorganic substance powder such as calcium carbonate, the particle surface may be previously modified in accordance with a common method. Examples of the surface modification method include physical methods such as plasma treatment and a method in which the surface is subjected to chemical surface treatment with a coupling agent or a surfactant. Examples of the coupling agent include a silane coupling agent and a titanium coupling agent. As the surfactant, any of an anionic surfactant, a cationic surfactant, a nonionic surfactant, and an amphoteric surfactant may be used. Examples of the surfactant include higher fatty acids, higher fatty acid esters, higher fatty acid amides, and higher fatty acid salts. In the case where heavy calcium carbonate is used, the particle surface of heavy calcium carbonate may be partially oxidized and may partially include a calcium oxide composition.

The average particle diameter of the inorganic substance powder such as heavy calcium carbonate is preferably 1.0 μm or more and 10.0 μm or less, more preferably 0.5 μm or more and 5.0 μm or less, and particularly preferably 1.0 μm or more and 3.0 μm or less. The average particle diameter of the inorganic substance powder described in the present specification refers to a value calculated from the measurement result of the specific surface area by the air permeation method in accordance with JIS M-8511. As a measurement apparatus, for example, a specific surface area measurement apparatus Type SS-100 manufactured by SHIMADZU CORPORATION may be preferably used. In particular, in the particle diameter distribution of the inorganic substance powder, particles having a particle diameter of 50.0 μm or more are preferably excluded. On the other hand, excessively fine particles cause the viscosity at the time of kneading with the above-described thermoplastic resin to significantly increase and thus spinnability may deteriorate. Therefore, the average particle diameter is preferably set to 0.1 μm or more.

Although not particularly limited, the specific surface area of the inorganic substance powder such as heavy calcium carbonate in accordance with a BET adsorption method is desirably 0.1 $m^2/g$ or more and 10.0 $m^2/g$ or less, more preferably 0.2 $m^2/g$ or more and 5.0 $m^2/g$ or less, and further preferably 1.0 $m^2/g$ or more and 3.0 $m^2/g$ or less. The BET adsorption method described here is in accordance with a nitrogen gas adsorption method. The specific surface area within this range allows the physical properties of the obtained nonwoven fabric to be improved, and at the same time, deterioration in spinnability due to blend of the heavy calcium carbonate particles not to occur frequently.

The irregular shape properties of the inorganic substance powder such as heavy calcium carbonate can be represented by the low degree of spheroidization of the particle shape. Specifically, roundness is desirably 0.50 or more and 0.95 or less, more preferably 0.55 or more and 0.93 or less, and further preferably 0.60 or more and 0.90 or less. The inorganic substance powder used in the present invention having the roundness within this range allows the strength of the nonwoven fabric and the spinnability to be moderate.

Here, the roundness can be represented by (Projected area of particle)/(Area of a circle having the same perimeter as the projected perimeter of particle). The method for measuring the roundness is not particularly limited. For example, the projected area of the particle and the projected perimeter of the particle are measured from a micrograph and determined to be (A) and (PM), respectively. When the radius of a circle having the same perimeter as the projected perimeter of the particle is determined to be (r), and the area of the circle having the same perimeter as the projected perimeter of the particle is determined to be (B). Roundness$=A/B=A/\pi r^2=A\times 4\pi/(PM)^2$. These measurements are performed with generally commercially available image analysis software using the projection image of each particle obtained by a scanning microscope, a stereomicroscope, or the like, whereby the roundness can be determined.

[Proportion of Thermoplastic Resin to Inorganic Substance Powder]

The blend proportion (% by mass) of the thermoplastic resin and inorganic substance powder included in the inorganic substance powder-containing resin composition may be in a proportion of 50:50 to 10:90, preferably in a proportion of 48:52 to 10:90, more preferably in a proportion of 45:55 to 20:80, and further preferably in a proportion of 40:60 to 25:75. The inorganic substance powder-containing resin composition having a proportion of the inorganic substance powder of less than 50% by mass in the blend proportion of the thermoplastic resin and the inorganic substance powder does not always exhibit the physical properties targeted by the blend of inorganic substance powder and insufficiently contributes to the environmental aspect. On the other hand, the inorganic substance powder-containing resin composition having a proportion of the inorganic substance powder of more than 90% by mass may cause difficulty in spinning.

[Ethylene-Based Polymer Wax]

In the inorganic substance powder-containing resin composition that constitutes the nonwoven fabric according to the present invention, the ethylene-based polymer wax having a weight average molecular weight of 400 or more and 5,000 or less is included as described above. The inorganic substance powder-containing resin composition includes the ethylene-based polymer wax in an amount of 0.1 part by mass or more and 3.0 parts by mass or less relative to 100 parts by mass of the total amount of the thermoplastic resin and the inorganic substance powder.

As described above, the properties of the spunbond fiber in which the inorganic substance powder is highly filled cannot be sufficiently improved even when additives such as processing aids used in general resin processing is used. On the other hand, according to the fiber of the inorganic substance powder-containing resin composition in which the specific proportion of the ethylene-based polymer wax having a specific molecular weight is blended, the spinnability can be improved and the nonwoven fabric having excellent physical properties can be obtained by improving the dispersion state of each component in the inorganic substance powder-containing resin composition.

The ethylene-based polymer wax as described above is blended at a content of 0.1 part by mass or more and 3.0 parts by mass or less relative to 100 parts by mass of the total amount of the thermoplastic resin and the inorganic substance powder. The various contents can be set depending on the mass ratio of the thermoplastic resin and the inorganic substance powder, the physical properties of the target nonwoven fabric, the spinnability of the fiber, and the like. The content is preferably determined to be 0.2 part by mass or more and 2.5 parts by mass or less, more preferably 0.2 part by mass or more and 1.5 parts by mass or less, and particularly preferably 0.3 part by mass or more and 1.0 parts by mass or less relative to 100 parts by mass of the total amount of the thermoplastic resin and the inorganic substance powder.

Here, any known waxes can be used as the ethylene-based polymer wax. For example, Hi-Wax (registered trademark) and EXCEREX (registered trademark) manufactured by Mitsui Chemicals, SANWAX (registered trademark) manufactured by Sanyo Chemical Industry Co., Ltd., Epolene (registered trademark) manufactured by Eastman Chemical Company, Allied Wax (registered trademark) manufactured by Allied Signal Inc., and Paraflint (registered trademark) manufactured by SASOL Limited are commercially available. The "ethylene-based polymer wax" includes copolymers of ethylene and α-olefins and polymers including polypropylene as a main unit, in addition to ethylene homopolymers (therefore, also referred to as a "polyolefin wax"). Any of these waxes can be used. A plurality of types of the ethylene-based polymer waxes can be used in combination.

With respect to the ethylene-based polymer wax, the weight average molecular weight may be within the above-described range and ethylene-based polymer waxes having various molecular weights can be used depending on the type and the molecular weight of the thermoplastic resin used together. The ethylene-based polymer wax having a weight-average molecular weight of less than about 400 may cause the ethylene-based polymer wax to bleed out. On the other hand, the ethylene-based polymer wax having a weight-average molecular weight of more than about 5,000 results in lowered effect of improving the dispersibility of each component in the inorganic substance powder-containing resin composition. The ethylene-based polymer wax preferably having a weight average molecular weight of 500 to 4,000 and more preferably 1,000 to 3,000 is used.

In the case where, for example, a copolymer of ethylene and an α-olefin having a carbon number of 3 to 20 is used as the ethylene-based polymer wax, the carbon number of the α-olefin to be copolymerized with ethylene is preferably 3 to 8, more preferably 3 to 4, and particularly preferably 3. The ethylene-based polymer wax having the carbon number of the α-olefin to be copolymerized with ethylene within the above-described range allows the spinnability to be excellent and the strength and other properties of the nonwoven fabric to be improved. Even in the case where the ethylene homopolymer is used as the ethylene-based polymer wax, the inorganic substance powder-containing resin composition exhibits an excellent property in spinnability.

The ethylene-based polymer wax may be produced by any of commonly used methods such as a production method of polymerizing low molecular weight polymers or a production method of reducing the molecular weight of high molecular weight ethylene polymers by thermal cracking. These methods are not particularly limited. The ethylene-based polymer wax may be an ethylene-based polymer wax purified, for example, by solvent fractionation, in which the wax is fractionated by differences in solubility with respect to the solvent, or by distillation.

The melting point or softening temperature of ethylene-based polymer wax is also not particularly limited. For example, the ethylene-based polymer wax having melting point of 90 to 130° C. and particularly 95 to 125° C. or having a softening temperature of 95 to 135° C. and particularly 100 to 130° C. may be included.

The density of ethylene-based polymer wax is also not particularly limited and is preferably 0.890 to 0.990 g/cm$^3$ and more preferably 0.900 to 0.980 g/cm$^3$. Use of the ethylene-based polymer wax having a density within the above-described range allows the spinnability of the inorganic substance powder-containing resin composition to be likely to be excellent.

In the inorganic substance powder-containing resin composition, the difference between the density of the propylene-based resin and the density of the ethylene-based polymer wax is not particularly limited. The difference is preferably 0.10 g/cm$^3$ or less, more preferably 0.08 g/cm$^3$ or less, and particularly preferably 0.05 g/cm$^3$ or less. The inorganic substance powder-containing resin composition having the density difference within the above-described range allows the spinnability to be excellent and the strength and other properties of the nonwoven fabric to be improved.

[Other Additives]

To the inorganic substance powder-filled resin composition, other additives may be added as auxiliary agents, if necessary. As other additives, for example, colorants, lubricants, coupling agents, fluidity improvers, antioxidants, ultraviolet ray absorbers, flame retardants, stabilizers, antistatic agents, and plasticizers may be blended. These additives may be used singly or in combination of two or more of these additives. These additives may be blended at a kneading process or may be previously blended into other components such as the resin before the kneading process.

The amount of the added additives is not particularly limited. For example, when the entire inorganic substance powder-filled resin composition is determined to by 100% by mass, the additives are added so that the content of each additive is in a proportion of about 0 to about 5.0% by mass, preferably about 0.1 to about 3.0% by mass, and particularly preferably about 0.5 to about 2.0% by mass and the content of the entire additives is desirably in a proportion of 10.0% by mass or less.

Hereinafter, among these additives, the additives considered to be important will be described. However, the additives are not limited to additives exemplified below.

As the colorants, any of the known organic pigments, inorganic pigments, or dyes can be used. Specific examples include organic pigments such as azo, anthraquinone, phthalocyanine, quinacridone, isoindolinone, dioxazine, perinone, quinophthalone, and perylene pigments and inorganic pigments such as ultramarine blue, titanium oxide, titanium yellow, iron oxide (red iron oxide), chromium oxide, zinc white, and carbon black.

As the antioxidants, phosphorus-based antioxidants, phenol-based antioxidants, and pentaerythritol-based antioxidants can be used. The phosphorus-based, more specifically the phosphorus-based antioxidants such as phosphorous acid esters and phosphoric acid esters are preferably used. Examples of the phosphorous acid esters include triesters, diesters, and monoesters of phosphorous acid such as triphenyl phosphite, tris(nonylphenyl) phosphite, and tris(2,4-di-t-butylphenyl) phosphite.

Examples of the phosphoric acid ester include trimethyl phosphate, triethyl phosphate, tributyl phosphate, trioctyl phosphate, triphenyl phosphate, tricresyl phosphate, tris (nonylphenyl) phosphate, and 2-ethylphenyldiphenyl phosphate. These phosphorus-based antioxidants may be used singly or in combination of two or more of the phosphorus-based antioxidants.

Examples of the phenol-based antioxidants include α-tocopherol, butylhydroxytoluene, sinapyl alcohol, vitamin E, n-octadecyl-3-(3,5-di-t-butyl-4-hydroxyphenyl) propionate, 2-t-butyl-6-(3'-t-butyl-5'-methyl-2'-hydroxybenzyl)-4-methylphenyl acrylate, 2,6-di-t-butyl-4-(N,N-dimethylaminomethyl)phenol, 5-di-t-butyl-4-hydroxybenzylphosphonate diethyl ester, and tetrakis[3-(3,5-di-t-butyl-4-hydroxyphenyl)propionyloxymethyl]methane. These phenol-based antioxidants may be used singly or in combination of two or more of the phenol-based antioxidants.

The flame retardants are not particularly limited. For example, halogen-based flame retardants, phosphorus-based flame retardants and non-phosphorus-halogen-based flame retardants such as metal hydrates can be used. Specific examples of the halogen-based flame retardants include halogenated bisphenylalkanes, halogenated bisphenol-based compounds such as halogenated bisphenylethers, halogenated bisphenylthioethers, and halogenated bisphenylsulfones, and bisphenol-bis(alkyl ether)-based compounds such as brominated bisphenol A, brominated bisphenol S, chlorinated bisphenol A, and chlorinated bisphenol S. Examples of the phosphorus-based flame retardants include tris(diethylphosphinic acid) aluminum, bisphenol A bis(diphenyl phosphate), triaryl isopropyl phosphate compounds, cresyl di-2,6-xylenyl phosphate, and condensed aromatic phosphoric acid esters. Examples of the metal hydrates include aluminum trihydroxide, magnesium dihydroxide, and a combination thereof. These flame retardants may be used singly or in combination of two or more of the flame retardants. Furthermore, antimony oxides such as antimony trioxide and antimony pentoxide, zinc oxide, iron oxide, aluminum oxide, molybdenum oxide, titanium oxide, calcium oxide, and magnesium oxide can be used together as flame retardant aids.

<<(Production of Inorganic Substance Powder-Containing Resin Composition>>

The fiber constituting the nonwoven fabric according to the present invention is composed of the inorganic substance powder-filled resin composition obtained by kneading the above-described raw materials in a predetermined blend proportion. The method for kneading is not particularly limited and is appropriately determined depending on the spinning method. For example, the thermoplastic resin, the inorganic substance powder, the ethylene-based polymer wax, and other additives may be kneaded and melted before spinning molding or these raw materials may be kneaded and melted in a molding machine that integrates a kneading apparatus and a spinning apparatus and, at the same time, may be spun. Before the inorganic substance powder is added to the thermoplastic resin, the ethylene-based polymer wax and the inorganic substance powder may be subjected to a mixing process, or conversely, the ethylene-based polymer wax and the thermoplastic resin may be subjected to a mixing process. In melting and kneading, the inorganic substance powder is preferably uniformly dispersed in the thermoplastic resin and, at the same time, the mixture is kneaded by applying high shear stress. For example, the mixture is preferably kneaded using a twin-screw kneader.

In the case where the above-described raw materials are kneaded and melted before the spinning molding, the inorganic substance powder-filled resin composition may be molded once into the form of pellets. In this case, the shape of the pellets is not particularly limited. For example, pellets having a shape of cylinder, sphere, and ellipsoidal sphere can be formed. The size of the pellets may be appropriately determined depending on the shape and the kind of a spinning molding machine. For example, in the case of the spherical pellets, the diameter may be 1 mm or more and 10 mm or less. In the case of the ellipsoidal spherical pellets, the pellets may have an elliptical shape having an aspect ratio of 0.1 to 1.0 and having longitudinal and lateral lengths of 1 mm to 10 mm. In the case of cylindrical pellets, the diameter may be within a range of 1 mm to 10 mm and the length may be within a range of 1 mm to 10 mm.

<<Fiber of Inorganic Substance Powder-Filled Resin Composition>>

Spinning of the above-described inorganic substance powder-filled resin composition allows the fiber constituting the inorganic substance powder-blended spunbond nonwoven fabric according to the present invention to be obtained.

The spinning method is not particularly limited. The melt spinning method is preferable and the usual known methods can be used. The inorganic substance powder-filled resin composition constituted of the above-described constitution has excellent spinnability and thus the desired fiber can be produced using a general-purpose spinning apparatus. For example, the cross-sectional shape of the fiber can be formed into various shapes such as a round shape, an elliptical shape, polygonal shapes such as a triangular shape, a square shape, and a pentagonal shape, a star shape, and a hollow shape. In addition, to the extent that the object of the present invention is not impaired, the fiber may be a composite fiber having a side-by-side or core-sheath structure including the inorganic substance powder-containing resin composition having a different composition or other kinds of resin compositions.

The average fiber diameter of the fiber may be arbitrarily determined depending on the target nonwoven fabric and is preferably in the range of 5 to 30 μm. The average fiber diameter is more preferably 25 μm or less and particularly preferably 20 μm or less. The fiber having an average fiber diameter of less than about 20 μm allows the fiber forming the nonwoven fabric to be sufficiently thin and, therefore, to be suitably used for medical materials in particular. Although not particularly limited, the lower limit of the average fiber diameter is 5 μm or more, and particularly 10 μm or more. The fiber having this lower limit allows excellent strength to be obtained.

<<Method for Producing Inorganic Substance Powder-Blended Spunbond Nonwoven Fabric>>

The nonwoven fabric according to the present invention is a spunbond nonwoven fabric. The spun fiber is processed directly into a sheet-like product (web). Usually, the fiber of this web is bonded to form a nonwoven fabric. The basis weight of the nonwoven fabric is not particularly limited and can be determined to be any desired value depending on the purpose. In the nonwoven fabric according to the present invention, however, the fibers are highly filled with the inorganic substance powder and thus the basis weight is generally larger than that of general-purpose nonwoven fabrics. Although not limited, the basis weight may be determined to be, for example, in the range of 5 to 200 g/m$^2$ and particularly 10 to 100 g/m$^2$.

A spunbond method is not particularly limited and various known methods can be used. For example, the inorganic substance powder-filled resin composition is previously spun through a spinning nozzle, the spun long fiber filament is cooled by a cooling fluid or the like, and tension is applied to the filament by stretching with air to achieve a predetermined fineness. The obtained filament can be collected on a moving collection belt and deposited to a predetermined thickness to form a spunbond nonwoven fabric.

The web obtained as described above is preferably treated by binding and entangling. This is a method for bonding the fibers forming the web together. Examples of the representative method include, but are not limited to, a chemical bonding method using a binder, a thermal bonding method, and a mechanical bonding method. These methods can be used in combination. Examples of the binder used for the chemical bonding include emulsions such as acrylic emulsions, vinyl emulsions, urethane-based emulsions, polyester-based emulsions, and butadiene-based emulsions and hot-melt type powder resins such as polyolefins, ethylene vinyl acetate copolymers, low-melting point polyimide resins, saturated polyester resins, and styrene butadiene copolymers. The fibers can be chemically bonded together by impregnating, spraying, or printing these binders into or onto the web. The fibers may be bonded by using a binder including epoxy groups or the like and adding a curing agent such as melamine. Examples of the thermal bonding method include a calendering method, in which the web is passed through a clearance of two hot rolls; an air-through method, in which hot air is sent from one side of the web; an ultrasonic bonding method, in which high-frequency sound waves are used to generate heat in the fibers to melt the resin; and a steam jet method, in which high-temperature and high-pressure steam is injected to the web. Examples of the mechanical bonding methods include a needle punching method, in which fibers are entangled with each other by piercing the web with needles; a water flow entangling method, in which fibers are entangled with each other by high-pressure water flow, and a stitch bonding method, in which the web is sewn together. The general method for producing the spunbond nonwoven fabric is the calendering method, which includes an area bonding method (a full surface bonding method), a point bonding method (a point adhering method), and an embossing method. The inorganic substance powder-blended spunbond nonwoven fabric according to the present invention can be produced by any of these methods. These methods may be used in combination.

Of the above-described methods, the most common bonding method is the embossing method and the spunbond nonwoven fabric according to the present invention may also be partially thermocompressed by embossing processing or the like. The thermocompression allows the strength and other properties of spunbond nonwoven fabric to be increased and the balance of flexibility and air permeability to be improved. In the case where the thermocompression bonding is used, an embossed area ratio (thermocompression bonding area) is preferably 5 to 30% and particularly preferably 7 to 20%. An engraved shape is not limited. Examples of the shape may include a circle, an ellipse, a long circle, a square, a rhombus, a rectangle, a quilt, a lattice, a hexagon, or a continuous shape based on these shapes.

The spunbond nonwoven fabric may be subjected to secondary processing such as gearing processing, printing, coating, laminating, heat treatment, shaping processing, hydrophilic processing, water repellent processing, and press processing. The spunbond nonwoven fabric according to the present invention includes the inorganic substance powder and thus has the advantage of being easy to apply post-processing such as printing. In particular, the spunbond nonwoven fabric including calcium carbonate as the inorganic substance powder has high whiteness and thus is optimal for printing.

The spunbond nonwoven fabric may also be subjected to processing treatment such as water-repellent treatment. The water-repellent treatment allows the spunbond nonwoven fabric to be even more suitable for use as a waterproof sheet for construction and vehicles. In particular, in the case where the inorganic substance powder-blended spunbond nonwoven fabric is used for a medical gown, water, alcohol, oil, and the like are less likely to be penetrated into the spunbond nonwoven fabric and a barrier property is high in the case of disinfection with alcohol or attachment with blood or the like. The water repellent treatment can be performed, for example, by applying a processing agent such as a fluorine-based or silicone-based water repellent agent or by previously mixing the water repellent agent as an additive into the resin raw material to form the nonwoven fabric. The amount of the attached water repellent agent (or content) is preferably in the range of 0.5 to 10.0% by mass and particularly preferably in the range of 1.0 to 5.0% by mass. Processing treatment such as alcohol repellency can be performed by a similar method. The method for attaching is not particularly limited. Examples of the method include, but are not limited to, a method for spraying with a spraying tool, a method for dipping in a processing agent bath and squeezing with a mangle, or a method for coating. Examples of the drying method includes, but are not limited to, a method for using a hot air dryer, method for using a tenter, or method for contacting to a heating element.

Antistatic properties can also be imparted to the spunbond nonwoven fabric. Addition of the antistatic properties allows the inorganic substance powder-blended spunbond nonwoven fabric according to the present invention to be more suitable for use in factories or the like, particularly in painting factories or the like where a lot of solvents are used. Addition of the antistatic properties also allows wear comfort to be improved when the spunbond nonwoven fabric is used for medical gowns and other applications. Examples of methods for imparting the antistatic properties include, but are not limited to, a method for applying the antistatic agent such as fatty acid esters and quaternary ammonium salts or a method for mixing the antistatic agent as the additives with the resin raw material to form the nonwoven fabric. Such methods allow the antistatic property of the nonwoven fabric to be improved to, for example, 1,000 V or less in an atmosphere of 20° C. and 40% RH in accordance with the cotton cloth friction method described in JIS L1094C.

The spunbond nonwoven fabric can be applied for a variety of materials including medical materials, sanitary materials, construction and civil engineering materials, agricultural materials, vehicle materials, industrial materials such as filters and separators, materials for living such as clothing and covers, and artificial leathers. Specifically, the spunbond nonwoven fabric is suitable as a base fabric for medical gowns and caps, disposable diapers, sanitary napkins, and poultice materials, materials for bed covers, geotextiles, wall coverings, flooring materials, shading and seed raising sheets, vehicle interior materials, oil filters and air filters, wipers, covering materials, battery separators, absorbent products, packaging materials, carrying materials, backing materials, and the like. The inorganic substance powder-blended spunbond nonwoven fabric according to the present invention may be used singly and can also be used by laminating with other materials or stitching with other fiber materials.

The spunbond nonwoven fabric is highly filled with inorganic substance powder and thus the amount of waste plastic can be greatly reduced when the spunbond nonwoven fabric is disposed, resulting in contributing to the environmental aspect. In particular, this spunbond nonwoven fabric is suitable for medical gowns, caps, masks, isolation gowns, patient clothes, drapes, sheets, Kurum (disposable wrap for sterilization), towels, and other products used as disposable materials because of hygienic reasons. From the same reason, this spunbond nonwoven fabric is widely applicable for filter materials such as liquid filters and air filters. This spunbond nonwoven fabric is also suitable for use as the material for living such as oxygen absorbers, body warmers, warm compresses, masks, compact disc bags, food packaging materials, and clothing covers because post-processing such as printing is easy. Similarly, this spunbond nonwoven fabric is suitable for automobile interior materials and various backing materials.

EXAMPLES

Hereinafter, the present invention will be described more specifically with reference to Examples. These Examples are described only for the purpose of exemplifying specific aspects and embodiments in order to facilitate the understanding of the concept and scope of the present invention disclosed in the present specification and described in the appended claims. The present invention, however, is not limited to these Examples.

Examples 1 to 4 and Comparative Examples 1 and 2

A spunbond nonwoven fabric was prepared using 40.0 parts by mass of polypropylene as the thermoplastic resin, 60.0 parts by mass of calcium carbonate as the inorganic substance powder, and the ethylene-based polymer wax in the blend proportion listed in Table 1 and using 1.0 part by mass of respective antistatic agent and antioxidant. The details of the used raw materials are described below.

Polypropylene: Propylene homopolymer manufactured by Nihon Polypro Corporation: Novatech (registered trademark) BC06C, melt flow rate 60 g/10 min, and density 0.900 g/cm$^3$ Calcium carbonate: Heavy calcium carbonate manufactured by BIHOKU FUNKA KOGYO CO., LTD. Soften 1800, average particle diameter 1.25 μm, specific surface area 1.8 m$^2$/g, and no surface treatment Ethylene-based polymer wax: EXCEREX (registered trademark) 30200B manufactured by Mitsui Chemicals, Inc., weight average molecular weight 2,900, density 0.913 g/cm$^3$, melting point 102° C., and softening point 105° C.

Antistatic agent: Lauric acid diethanolamide

Antioxidant: Pentaerythritol tetrakis[3-(3',5'-di-t-butyl-4'-hydroxyphenyl)propionate]

The above-described raw materials were kneaded with a co-rotating twin-screw extruder (screw diameter 25 mm and L/D=41) at 200° C., extruded into water as strands, cooled, and cut to prepare pellets. From these pellets, melt spinning was performed using a twin-screw extruder at 230° C. After the obtained fiber was deposited on the collecting surface, spunbond nonwoven fabrics having a fiber diameter of 10 μm and a basis weight of 40 g/m$^2$ were fabricated by thermal embossing.

Each of the prepared spunbond nonwoven fabrics was inspected for abnormalities such as fiber diameter variation by performing appearance observation and examination by touching. The results are listed in Table 1 together with the blend proportions. The units for the blend proportion listed in Table 1 are "parts by mass".

TABLE 1

| | | Comparative Example 1 | Example 1 | Example 2 | Example 3 | Example 4 | Comparative Example 2 |
|---|---|---|---|---|---|---|---|
| Blend proportion | Polypropylene | 40.0 | 40.0 | 40.0 | 40.0 | 40.0 | 40.0 |
| | Calcium carbonate | 60.0 | 60.0 | 60.0 | 60.0 | 60.0 | 60.0 |
| | Ethelene-based polymer wax | — | 0.5 | 1.0 | 2.0 | 3.0 | 8.0 |
| Inspection result | Variation in fiber diameter | Noticeable | No variation | No variation | No variation | No variation | No variation |
| | Other appearance and texture | Each fiber is fuzzy | Excellent | Excellent | Excellent | Excellent | Wax bleeds out and surface is slippery |

As is clear from Table 1, according to the present invention, in the case where the blend amount of the ethylene-based polymer wax having a weight average molecular weight of 400 or more and 5,000 or less is within the range of 0.1 part by mass or more and 3.0 parts by mass or less relative to 100 parts by mass of the polypropylene and the calcium carbonate, the spunbond nonwoven fabric having excellent spinnability, uniform fiber diameter, and excellent appearance was obtained. On the other hand, the spunbond nonwoven fabric in Comparative Example 1, which did not include the ethylene-based polymer wax, could not be smoothly spun and each fiber was fuzzy and had remarkable fiber diameter variation. In addition, the spunbond nonwoven fabric in Comparative Example 1 easily broke only by pulling the spunbond nonwoven fabric by hand and thus was unbearable for practical use in terms of strength. It is presumed that dispersion and flowability were not secured and the components in the fiber were ununiformly distributed, resulting in existence of scattered areas where mechanical strength was low. In Comparative Example 2, in which a large amount of the ethylene-based polymer wax was blended, the wax bled out and the surface of the spunbond nonwoven fabric was slippery. With respect to medical and filler applications, in particular, use of such a nonwoven fabric in Comparative Example 2 is considered to be problematic. On the other hand, in Examples 1 to 4, the spunbond nonwoven fabrics that did not have such slippage and had elastic and flexible texture were obtained.

Example 5

A spunbond nonwoven fabric was prepared in the same manner as the manner in Example 1 except that 30 parts by mass of the polypropylene used in Example 1, 70 parts by mass of the following calcium carbonate, 2.0 parts by mass of the following ethylene-based polymer wax, and 1.0 part by mass of the antioxidant used in Example 1 were used. The results obtained by inspecting by the same manner as the manner in Example 1 are listed in Table 2. The roundness of the calcium carbonate particles was determined by analyzing optical microscope images of 100 particles using commercially available image analysis software.

Calcium carbonate: Heavy calcium carbonate manufactured by BIHOKU FUNKA KOGYO CO., LTD. Soften 1000, average particle diameter 2.20 μm, specific surface area 1.0 $m^2/g$, roundness 0.8512, and no surface treatment Ethylene-based polymer wax: EXCEREX (registered trademark) 40800 manufactured by Mitsui Chemicals, Inc., a weight average molecular weight 4,000, a density 0.980 $g/cm^3$, melting point 128° C., and softening point 135° C.

Example 6 and Comparative Examples 3 to 5

Spunbond nonwoven fabrics were prepared in the same manner as the manner in Example 3 except that, instead of EXCEREX (registered trademark) 30200B used in Examples 1 to 4, 2.0 parts by mass of each of the ethylene-based polymer waxes (SANWAX (registered trademark), manufactured by Sanyo Chemical Industry Co., Ltd., weight average molecular weight 2,900 and 9,500), eicosane ($C_{20}H_{42}$, molecular weight 282.6), or carnauba wax was used. The obtained spunbond nonwoven fabrics are inspected. The results are listed in Table 2.

TABLE 2

| | Example 5 | Example 6 | Comparative Example 3 | Comparative Example 4 | Comparative Example 5 |
|---|---|---|---|---|---|
| Wax | Ethylene-based polymer (Molecular weight 4,000) | Ethylene-based polymer (Molecular weight 2,900) | Ethylene-based polymer (Molecular weight 9,500) | Eicosane (Molecular weight 282.6) | Carnauba wax |
| Inspection result | No variation in fiber diameter and no slippage | No variation in fiber diameter and no slippage | Slight variation in fiber diameter | Bleeding out occurs | Fiber diameter varies |

As listed in Table 2, use of the ethylene-based polymer waxes having weight average molecular weights outside the range of 400 to 5,000 caused variations in the fiber diameter and bleeding. The nonwoven fabric in Comparative Example 3, which used the ethylene-based polymer wax having a weight average molecular weight of more than 5,000, caused areas having fiber diameter variation to be observed, while appearance and texture were better than those of the nonwoven fabrics in Comparative Examples 4 and 5. In Comparative Example 3, spinning was also slightly more difficult than the spinning in Example 5 and other examples. There was possibility that the dispersibility of each component and the flowability of the resin composition were insufficient. On the contrary, in Comparative Example 4, in which a component having a molecular weight of less than 400 is blended, eicosane (ethylene oligomer having a carbon number of 20) bled out. In the spunbond fabric in Comparative Example 5, in which carnauba wax was used instead of the ethylene-based polymer wax, variation in the fiber diameters was observed. On the other hand, according to the present invention, blend of the ethylene-based polymer wax having a weight average molecular weight of 400 to 5,000 allows the spunbond nonwoven fabrics having no variation in fiber diameter due to excellent dispersibility and spinnability and having sufficient mechanical properties and elasticity to be obtained, while the spunbond nonwoven fabrics were highly filled with the inorganic substance powder.

The invention claimed is:

1. An inorganic substance powder-blended spunbond nonwoven fabric composed of a fiber, the fiber comprising: a thermoplastic resin and an inorganic substance powder in a mass ratio of 50:50 to 10:90, and an ethylene-based polymer wax having a weight average molecular weight of 400 or more and 5,000 or less in an amount of 0.1 part by mass or more and 3.0 parts by mass or less relative to 100 parts by mass of a total amount of the thermoplastic resin and the inorganic substance powder, wherein the inorganic substance powder is heavy calcium carbonate particles having an average particle diameter determined by an air permeation method in accordance with JIS M-8511 of 1.0 μm or more and 5.0 μm or less, and a roundness of the heavy calcium carbonate particles is 0.50 or more and 0.95 or less.

2. The inorganic substance powder-blended spunbond nonwoven fabric according to claim 1, wherein a BET specific surface area of the heavy calcium carbonate particles is 0.1 $m^2/g$ or more and 10.0 $m^2/g$ or less.

3. The inorganic substance powder-blended spunbond nonwoven fabric according to claim 2, wherein the thermoplastic resin is a thermoplastic resin comprising a polypropylene-based resin.

4. The inorganic substance powder-blended spunbond nonwoven fabric according to claim 3, wherein the polypropylene-based resin is a homopolymer of polypropylene having a melt flow rate (MFR) of 50 g/10 min or more and 70 g/10 min or less.

5. The inorganic substance powder-blended spunbond nonwoven fabric according to claim 2, wherein a density of the ethylene-based polymer wax is 0.890 g/cm$^3$ or more and 0.990 g/cm$^3$ or less.

6. The inorganic substance powder-blended spunbond nonwoven fabric according to claim 1, wherein the thermoplastic resin is a thermoplastic resin comprising a polypropylene-based resin.

7. The inorganic substance powder-blended spunbond nonwoven fabric according to claim 6, wherein the polypropylene-based resin is a homopolymer of polypropylene having a melt flow rate (MFR) of 50 g/10 min or more and 70 g/10 min or less.

8. The inorganic substance powder-blended spunbond nonwoven fabric according to claim 7, wherein a density of the ethylene-based polymer wax is 0.890 g/cm$^3$ or more and 0.990 g/cm$^3$ or less.

9. The inorganic substance powder-blended spunbond nonwoven fabric according to claim 6, wherein a density of the ethylene-based polymer wax is 0.890 g/cm$^3$ or more and 0.990 g/cm$^3$ or less.

10. The inorganic substance powder-blended spunbond nonwoven fabric according to claim 1, wherein a density of the ethylene-based polymer wax is 0.890 g/cm$^3$ or more and 0.990 g/cm$^3$ or less.

* * * * *